US009910403B2

(12) United States Patent
Amann et al.

(10) Patent No.: US 9,910,403 B2
(45) Date of Patent: Mar. 6, 2018

(54) POSITIONING FEATURES FOR ELECTRICAL CONTACTS OF A REPLACEABLE UNIT OF AN ELECTROPHOTOGRAPHIC IMAGE FORMING DEVICE

(71) Applicant: LEXMARK INTERNATIONAL, INC., Lexington, KY (US)

(72) Inventors: Mark William Amann, Lexington, KY (US); Gregory Alan Cavill, Winchester, KY (US); Katrina Rosit Lactuan, Cebu (PH); James Richard Leemhuis, Lexington, KY (US); Darren Wayne Tosh, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/384,377

(22) Filed: Dec. 20, 2016

(65) Prior Publication Data

US 2017/0205752 A1 Jul. 20, 2017

Related U.S. Application Data

(60) Provisional application No. 62/279,921, filed on Jan. 18, 2016.

(51) Int. Cl.
*G03G 21/00* (2006.01)
*H01R 13/00* (2006.01)
(Continued)

(52) U.S. Cl.
CPC ..... *G03G 21/1652* (2013.01); *G03G 15/80* (2013.01); *G03G 21/1871* (2013.01); *H01R 13/629* (2013.01); *G03G 2221/166* (2013.01)

(58) Field of Classification Search
CPC ..... G03G 15/80; G03G 21/1652; G03G 21/1867; G03G 21/1871; G03G 2221/166;
(Continued)

(56) References Cited

U.S. PATENT DOCUMENTS 4,824,388 A 4/1989 Pickel
4,839,691 A 6/1989 Tagawa et al.
(Continued)

FOREIGN PATENT DOCUMENTS

CN 1841231 A 10/2006
CN 102262387 A 11/2011
(Continued)

OTHER PUBLICATIONS

International Search Report and Written Opinion of the International Searching Authority dated Apr. 4, 2017 for PCT Application No. PCT/US2017/013639.
(Continued)

*Primary Examiner* — Robert Beatty
(74) *Attorney, Agent, or Firm* — Justin M. Tromp

(57) ABSTRACT

A replaceable unit for an electrophotographic image forming device according to one embodiment includes a pocket formed on a first side of a housing. A bottom end of the pocket is open for receiving an electrical connector during insertion of the replaceable unit into the image forming device. An electrical contact is positioned within the pocket and is electrically connected to processing circuitry on the housing. An outer guide is positioned on the first side of the housing and below the pocket. A portion of the outer guide inclines inward toward the first side of the housing as the outer guide extends upward. An inner guide is positioned within the pocket on a first inner surface of the pocket, which faces toward the first side of the housing. A portion of the
(Continued)

inner guide inclines inward toward the first side of the housing as the inner guide extends upward.

15 Claims, 17 Drawing Sheets

(51) Int. Cl.
*G03G 21/16* (2006.01)
*G03G 15/00* (2006.01)
*G03G 21/18* (2006.01)
*H01R 13/629* (2006.01)

(58) Field of Classification Search
CPC ... H01R 13/629; H01R 13/64; H01R 13/6315
USPC ..... 399/90, 262; 347/86; 439/374
See application file for complete search history.

(56) References Cited

U.S. PATENT DOCUMENTS 4,891,017 A 1/1990 Kuhn et al.
5,002,497 A 3/1991 Plocek et al.
5,259,779 A 11/1993 Ooya et al.
5,392,371 A 2/1995 Morlion et al.
5,490,802 A 2/1996 Plyler et al.
5,605,150 A 2/1997 Radons et al.
5,716,234 A * 2/1998 Phillips ..... H01R 13/4365 439/595
5,746,617 A 5/1998 Porter, Jr. et al.
5,937,239 A 8/1999 Watanabe et al.
5,946,531 A 8/1999 Miura et al.
5,997,329 A 12/1999 Kosmala
6,014,533 A 1/2000 Kawana
6,014,536 A 1/2000 Ban et al.
6,097,908 A 8/2000 Uchiyama et al.
6,168,262 B1 1/2001 Clark et al.
6,186,809 B1 2/2001 Kung
6,254,408 B1 7/2001 Hattori et al.
6,349,182 B2 2/2002 Otsubo et al.
6,361,350 B2 * 3/2002 Johnson ..... H01R 12/7005 439/374
6,386,899 B1 5/2002 Ushio et al.
6,502,917 B1 1/2003 Shinada et al.
6,582,039 B2 6/2003 Johnson et al.
6,652,309 B2 11/2003 Sukagawa
6,773,283 B2 8/2004 Yoshimatsu et al.
6,786,750 B2 9/2004 Itoh
6,848,925 B2 2/2005 Nishide
7,074,084 B2 7/2006 Shuey et al.
7,086,872 B2 8/2006 Myer et al.
7,258,558 B1 8/2007 Dawson et al.
7,272,336 B1 9/2007 Dawson et al.
7,831,168 B2 11/2010 Allen et al.
8,200,126 B2 6/2012 Chaudhuri et al.
8,862,016 B2 * 10/2014 Oda ..... G03G 21/1821 399/90
8,867,966 B2 10/2014 Acosta et al.
8,867,970 B2 10/2014 Acosta et al.
8,879,953 B2 11/2014 Amann et al.
8,938,179 B2 1/2015 Amann et al.
9,170,559 B2 10/2015 Amann et al.
9,360,834 B1 6/2016 Payne et al.
9,429,899 B2 8/2016 Amann et al.
9,482,989 B1 11/2016 Payne et al.
9,551,974 B1 * 1/2017 Martin ..... G03G 21/1652
9,746,815 B2 * 8/2017 Carpenter ..... G03G 15/80
2002/0025725 A1 2/2002 Ushio et al.
2002/0057319 A1 5/2002 Saruta et al.
2003/0035016 A1 2/2003 Tanaka
2003/0118367 A1 6/2003 Omata et al.
2003/0123896 A1 7/2003 Goto et al.
2003/0215261 A1 11/2003 Karakama et al.
2003/0223775 A1 12/2003 Yoshino et al.
2005/0135838 A1 6/2005 Miller
2006/0067725 A1 3/2006 Miyabe et al.
2006/0103701 A1 5/2006 Chan
2007/0086806 A1 4/2007 Burchette et al.
2007/0098437 A1 5/2007 Kaiga
2007/0230999 A1 10/2007 Shimomura
2008/0159772 A1 7/2008 Koishi et al.
2009/0196647 A1 8/2009 Nishimoto
2010/0104312 A1 4/2010 Kawai et al.
2010/0221039 A1 9/2010 Kawai et al.
2013/0273768 A1 * 10/2013 Peng ..... H01R 13/629 439/374
2014/0017932 A1 * 1/2014 Ohyama ..... H01R 12/79 439/374
2014/0169824 A1 6/2014 Seto et al.
2017/0205762 A1 * 7/2017 Amann ..... G03G 21/1652
2017/0277119 A1 * 9/2017 Sakai ..... G03G 21/1867

FOREIGN PATENT DOCUMENTS

EP 1411598 A2 4/2004
JP 2005195884 A 7/2005
JP 2010020219 A 1/2010
WO 2011155642 A1 12/2011

OTHER PUBLICATIONS

U.S. Appl. No. 15/384,379, filed Dec. 20, 2016 (Amann et al. ).

* cited by examiner

POSITIONING FEATURES FOR ELECTRICAL CONTACTS OF A REPLACEABLE UNIT OF AN ELECTROPHOTOGRAPHIC IMAGE FORMING DEVICE

CROSS REFERENCES TO RELATED APPLICATIONS

This application claims priority to U.S. Provisional Patent Application Ser. No. 62/279,921, filed Jan. 18, 2016, entitled "Positioning Features for Electrical Contacts of a Replaceable Unit of an Electrophotographic Image Forming Device," the content of which is hereby incorporated by reference in its entirety.

BACKGROUND

1. Field of the Disclosure

The present invention relates generally to electrophotographic image forming devices and more particularly to positioning features for electrical contacts of a replaceable unit of an electrophotographic image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The electrophotographic image forming device typically includes one or more customer replaceable units that have a shorter lifespan than the image forming device. For example, the image forming device may include replaceable unit(s) that replenish the image forming device's toner supply and/or that replace worn imaging components, such as the photoconductive drum, etc. It is desired to communicate various operating parameters and usage information of the replaceable unit(s) to the image forming device for proper operation. For example, it may be desired to communicate such information as replaceable unit serial number, replaceable unit type, toner color, toner capacity, amount of toner remaining, license information, etc. The replaceable unit(s) typically include processing circuitry configured to communicate with and respond to commands from a controller in the image forming device. The replaceable unit(s) also include memory associated with the processing circuitry that stores program instructions and information related to the replaceable unit. The processing circuitry and associated memory are typically mounted on a circuit board that is attached to the replaceable unit. The replaceable unit also includes one or more electrical contacts that mate with corresponding electrical contacts in the image forming device upon installation of the replaceable unit in the image forming device in order to facilitate communication between the processing circuitry of the replaceable unit and the controller of the image forming device. It is important to accurately position the electrical contacts of the replaceable unit relative to the corresponding electrical contacts of the image forming device in order to ensure a reliable connection between the processing circuitry of the replaceable unit and the controller of the image forming device when the replaceable unit is installed in the image forming device.

Accordingly, positioning features that provide precise alignment of the electrical contacts of the replaceable unit with corresponding electrical contacts of the image forming device are desired.

SUMMARY

A replaceable unit for an electrophotographic image forming device according to one example embodiment includes a housing having a top, a bottom, a first side and a second side formed between a first end and a second end of the housing. A pocket is formed on the first side of the housing. A bottom end of the pocket is open for receiving an electrical connector during insertion of the replaceable unit along a downward insertion direction into the image forming device. An electrical contact is positioned within the pocket. The electrical contact is electrically connected to processing circuitry mounted on the housing. An outer guide is positioned on the first side of the housing. The outer guide is positioned ahead of the pocket along the downward insertion direction. At least a portion of the outer guide inclines inward toward the first side of the housing as the outer guide extends upward. An inner guide is positioned within the pocket on a first inner surface of the pocket. The first inner surface of the pocket faces inward toward the first side of the housing. At least a portion of the inner guide inclines inward toward the first side of the housing as the inner guide extends upward.

A replaceable unit for an electrophotographic image forming device according to another example embodiment includes a housing having a top, a bottom, a first side and a second side formed between a first end and a second end of the housing. A photoconductive drum is mounted on the housing and has a rotational axis that runs from the first end to the second end. A downward facing pocket is formed on the first side of the housing. A bottom end of the pocket is open for receiving an electrical connector when the replaceable unit is installed in the image forming device. An electrical contact is positioned within the pocket on a first inner surface of the pocket that is positioned against the first side of the housing. The electrical contact is electrically connected to processing circuitry mounted on the housing. A pair of outer guides is positioned on the first side of the housing. The outer guides are spaced below the bottom end of the pocket and are spaced from each other along an axial dimension of the photoconductive drum. At least a portion of each of the outer guides inclines inward toward the first side of the housing as said outer guide extends upward. An inner guide is positioned within the pocket on a second inner surface of the pocket. The second inner surface of the pocket faces inward toward the first side of the housing and is spaced opposite the first inner surface of the pocket. At least a portion of the inner guide inclines inward toward the first side of the housing as the inner guide extends upward.

A replaceable unit for an electrophotographic image forming device according to another example embodiment includes a housing having a top, a bottom, a first side and a second side formed between a first end and a second end of the housing. A photoconductive drum is mounted on the housing and has a rotational axis that runs from the first end to the second end. A downward facing pocket is formed on the first side of the housing. A bottom end of the pocket is open for receiving an electrical connector when the replaceable unit is installed in the image forming device. An electrical contact is positioned within the pocket. The electrical contact is electrically connected to processing circuitry mounted on the housing. An outer guide is positioned on the first side of the housing. The outer guide is spaced below the bottom end of the pocket. At least a portion of the outer guide inclines inward toward the first side of the housing as the outer guide extends upward. A protruding portion of the housing protrudes from the first side of the housing below the outer guide. The protruding portion of the housing houses a channel for moving toner cleaned from an outer surface of the photoconductive drum.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
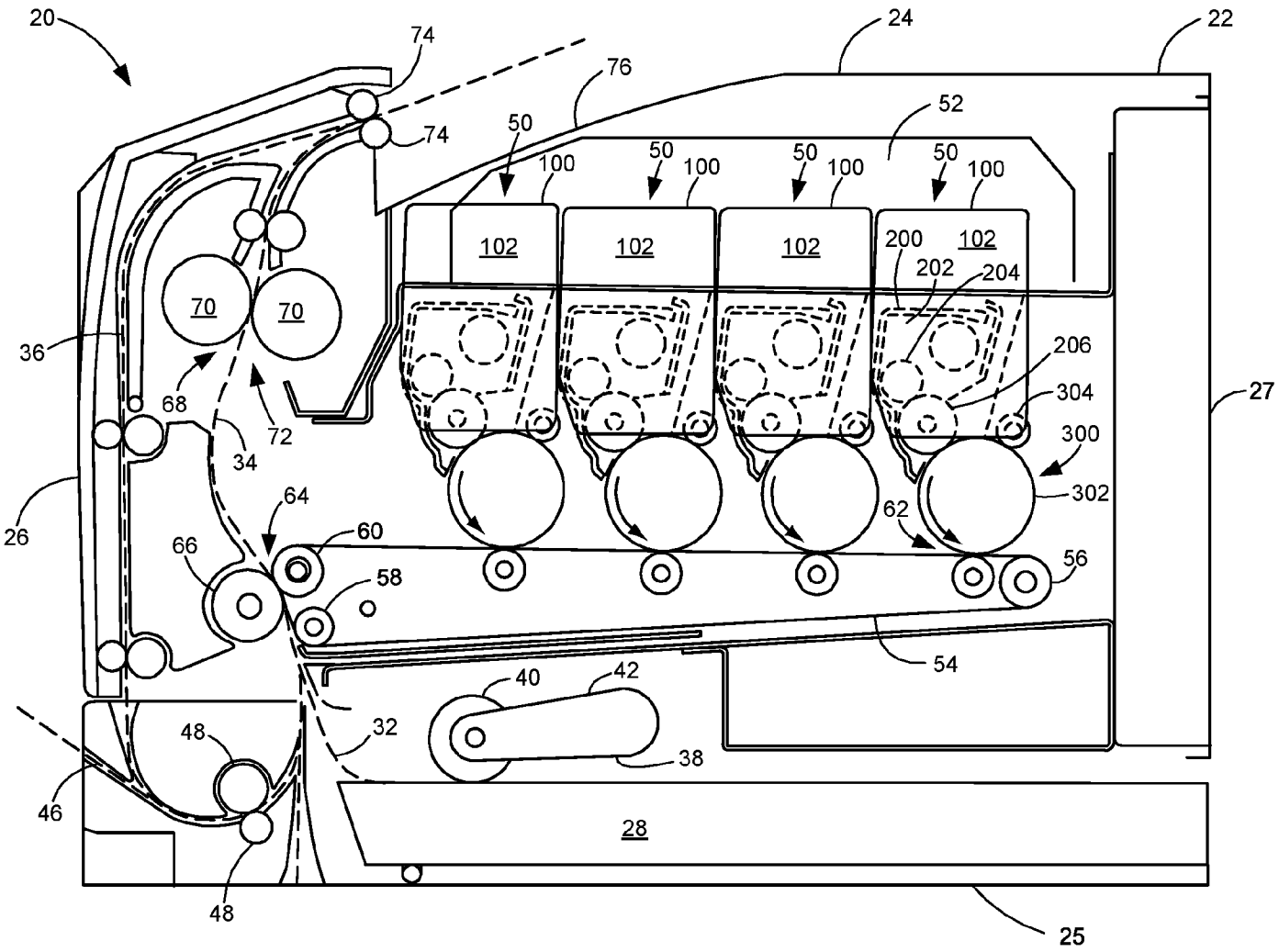
FIG. 1 is a schematic side view of the interior of an image forming device according to one example embodiment.

FIG. 1 illustrates a schematic view of the interior of an example image forming device 20. Image forming device 20 includes a housing 22 having a top 24, bottom 25, front 26 and rear 27. Housing 22 includes one or more input trays 28 positioned therein. Trays 28 are sized to contain a stack of media sheets. As used herein, the term media is meant to encompass not only paper but also labels, envelopes, fabrics, photographic paper or any other desired substrate. Trays 28 are preferably removable for refilling. A control panel (not shown) may be located on housing 22. Using the control panel, a user is able to enter commands and generally control the operation of the image forming device 20. For example, the user may enter commands to switch modes (e.g., color mode, monochrome mode), view the number of pages printed, etc. A media path 32 extends through image forming device 20 for moving the media sheets through the image transfer process. Media path 32 includes a simplex path 34 and may include a duplex path 36. A media sheet is introduced into simplex path 34 from tray 28 by a pick mechanism 38. In the example embodiment shown, pick mechanism 38 includes a roll 40 positioned at the end of a pivotable arm 42. Roll 40 rotates to move the media sheet from tray 28 and into media path 32. The media sheet is then moved along media path 32 by various transport rolls. Media sheets may also be introduced into media path 32 by a manual feed 46 having one or more rolls 48.

Image forming device 20 includes an image transfer section that includes one or more imaging stations 50. In the example embodiment illustrated, each imaging station 50 includes a toner cartridge 100, a developer unit 200 and a photoconductor unit 300. Each toner cartridge 100 includes a reservoir 102 for holding toner and an outlet port in communication with an inlet port of a corresponding developer unit 200 for periodically transferring toner from reservoir 102 to developer unit 200 in order to replenish the developer unit 200. One or more agitating members may be positioned within reservoir 102 to aid in moving the toner. In the example embodiment illustrated, image forming device 20 utilizes what is commonly referred to as a single component development system. In this embodiment, each developer unit 200 includes a toner reservoir 202 and a toner adder roll 204 that moves toner from reservoir 202 to a developer roll 206. Each photoconductor unit 300 includes a charge roll 304, a photoconductive (PC) drum 302 and a cleaner blade or roll (not shown). PC drums 302 are mounted substantially parallel to each other. For purposes of clarity, developer unit 200 and photoconductor unit 300 are labeled on only one of the imaging stations 50. Each imaging station 50 may be substantially the same except for the color of toner used.

Each charge roll 304 forms a nip with the corresponding PC drum 302. During a print operation, charge roll 304 charges the surface of PC drum 302 to a specified voltage such as, for example, −1000 volts. A laser beam from a printhead 52 associated with each imaging station 50 is then directed to the surface of PC drum 302 and selectively discharges those areas it contacts to form a latent image on the surface of PC drum 302. In one embodiment, areas on PC drum 302 illuminated by the laser beam are discharged to approximately −300 volts. Developer roll 206, which forms a nip with the corresponding PC drum 302, then transfers toner to the latent image on the surface of PC drum 302 to form a toner image. The toner is attracted to the areas of PC drum 302 surface discharged by the laser beam from the printhead 52. A metering device, such as a doctor blade, can be used to meter toner onto developer roll 206 and apply a desired charge on the toner prior to its transfer to PC drum 302.

An intermediate transfer mechanism (ITM) 54 is disposed adjacent to the imaging stations 50. In this embodiment, ITM 54 is formed as an endless belt trained about a drive roll 56, a tension roll 58 and a back-up roll 60. During image forming operations, ITM 54 moves past imaging stations 50 in a clockwise direction as viewed in FIG. 1. One or more of PC drums 302 apply toner images in their respective colors to ITM 54 at a first transfer nip 62. In one embodiment, a positive voltage field attracts the toner image from PC drums 302 to the surface of the moving ITM 54. ITM 54 rotates and collects the one or more toner images from imaging stations 50 and then conveys the toner images to a media sheet at a second transfer nip 64 formed between a transfer roll 66 and ITM 54, which is supported by back-up roll 60. The cleaner blade/roll of each photoconductor unit 300 removes any toner remnants on PC drum 302 so that the surface of PC drum 302 may be charged and developed with toner again.

A media sheet advancing through simplex path 34 receives the toner image from ITM 54 as it moves through the second transfer nip 64. The media sheet with the toner image is then moved along the media path 32 and into a fuser area 68. Fuser area 68 includes fusing rolls or belts 70 that form a nip 72 to adhere the toner image to the media sheet. The fused media sheet then passes through exit rolls 74 that are located downstream from the fuser area 68. Exit rolls 74 may be rotated in either forward or reverse directions. In a forward direction, exit rolls 74 move the media sheet from simplex path 34 to an output area 76 on top 24 of image forming device 20. In a reverse direction, exit rolls 74 move the media sheet into duplex path 36 for image formation on a second side of the media sheet.

While the example image forming device 20 shown in FIG. 1 illustrates four toner cartridges 100 and four corresponding developer units 200 and photoconductor units 300, it will be appreciated that a monocolor image forming device 20 may include a single toner cartridge 100 and corresponding developer unit 200 and photoconductor unit 300 as compared to a multicolor image forming device 20 that may include multiple toner cartridges 100, developer units 200 and photoconductor units 300. Further, although image forming device 20 utilizes ITM 54 to transfer toner to the media, toner may be applied directly to the media by the one or more PC drums 302 as is known in the art.

While the example image forming device 20 shown in FIG. 1 utilizes a single component development system, in another embodiment, image forming device 20 utilizes what is commonly referred to as a dual component development system. In this embodiment, reservoir 202 of developer unit 200 stores a mixture of toner and magnetic carrier beads. The carrier beads may be coated with a polymeric film to provide triboelectric properties to attract toner to the carrier beads as the toner and the carrier beads are mixed in reservoir 202. Each developer unit 200 also includes a magnetic roll that attracts the carrier beads in reservoir 202 having toner thereon to the magnetic roll through the use of magnetic fields and transports the toner to the corresponding PC drum 302. Electrostatic forces from the latent image on PC drum 302 strip the toner from the carrier beads to form a toner image on the surface of PC drum 302. PC drum 302 is charged by charge roll 304 and cleaned by a cleaner blade/roll as discussed above.

Figure 2:
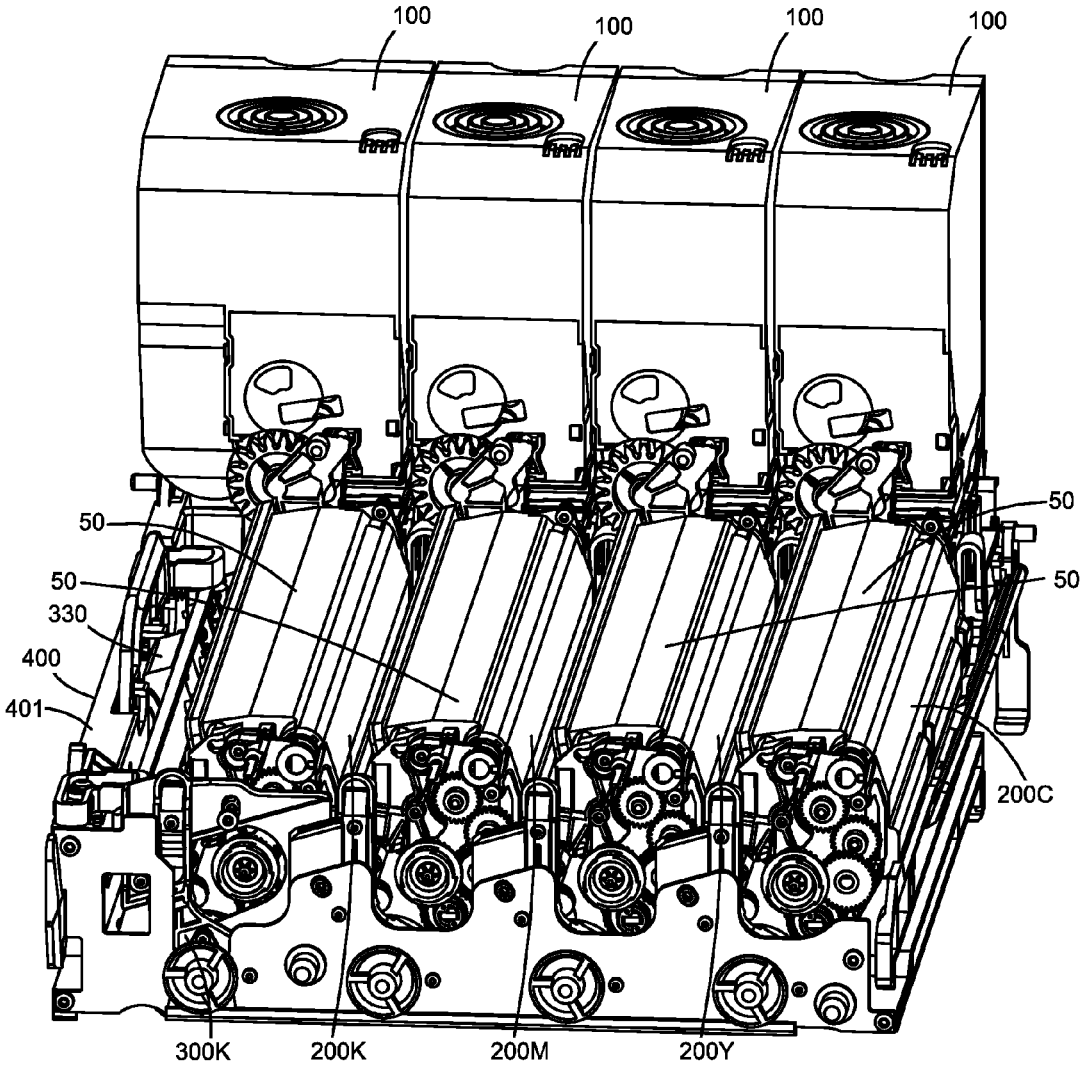
FIG. 2 is a perspective view of an imaging basket loaded with four toner cartridges, developer units and photoconductor units according to one example embodiment.
Figure 3:
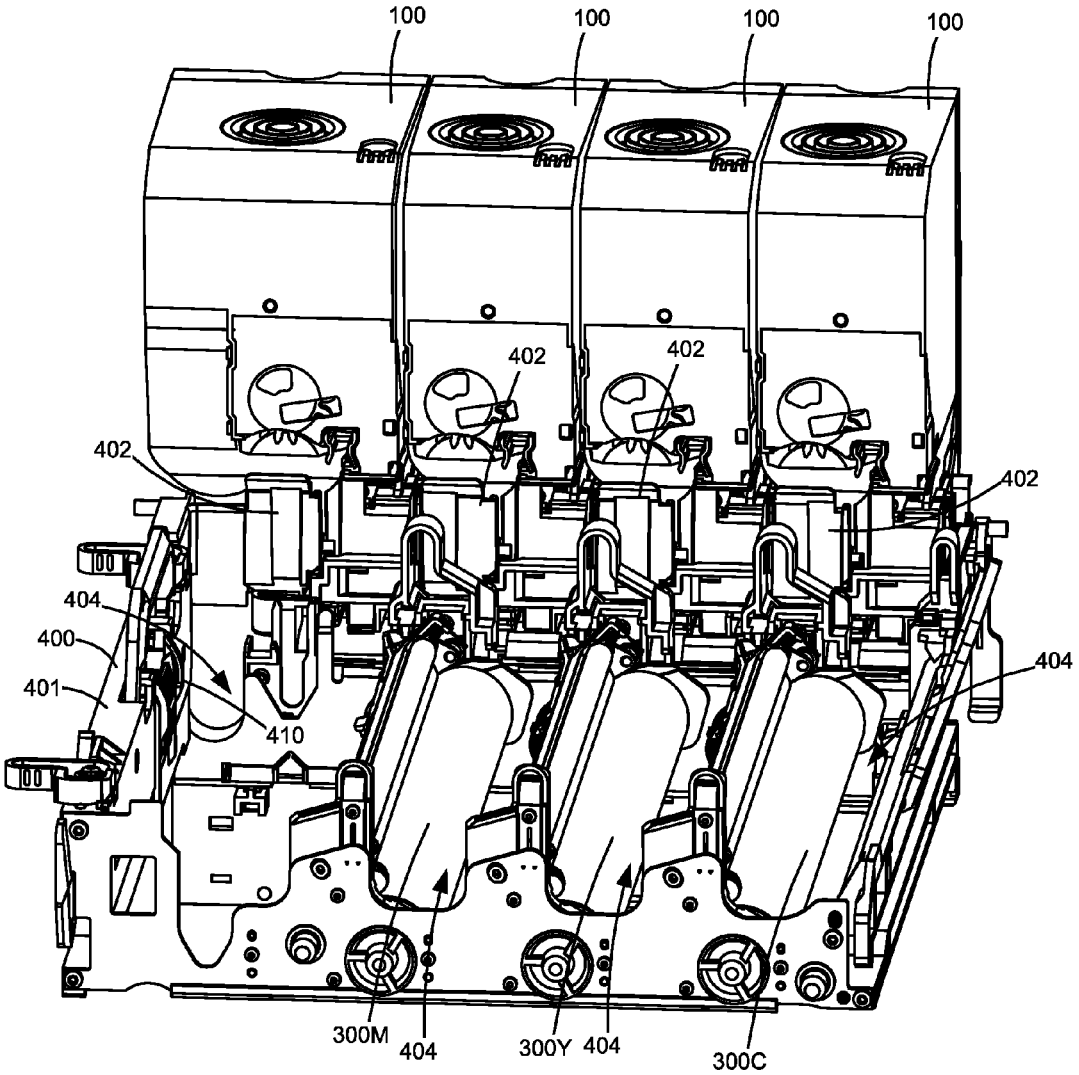
FIG. 3 is a perspective view of the imaging basket shown in FIG. 2 with the developer units and a black photoconductor unit removed according to one example embodiment.

With reference to FIGS. 2 and 3, image forming device 20 includes an imaging basket 400 having a frame 401 that holds imaging stations 50. In some embodiments, imaging basket 400 is removably installable in image forming device 20. Imaging basket 400 includes four cradles 402 that each hold a respective toner cartridge 100 and four positioning slots 404 that each hold a respective developer unit 200. The example embodiment illustrated includes four developer units 200 including a developer unit 200K, which forms part of the black toner imaging station 50, and developer units 200M, 200Y, 200C, which form parts of the colored toner (e.g., magenta, yellow and cyan) imaging stations 50. Toner cartridges 100 and developer units 200 are separately removable from imaging basket 400 in order to permit replacement of each toner cartridge 100 and developer unit 200 individually. Photoconductor units 300 may be removable from positioning slots 404 of imaging basket 400 or fixed thereto. In the example embodiment illustrated, the photoconductor unit 300K on the far left as viewed in FIG. 2, which forms part of the black toner imaging station 50, is removable from imaging basket 400 while the remaining three photoconductor units 300M, 300Y, 300C, which form parts of the colored toner (e.g., magenta, yellow and cyan)

imaging stations 50, are fixed to imaging basket 400. This configuration permits replacement of the black photoconductor unit 300K separate from the colored photoconductor units 300M, 300Y, 300C in the event that the black photoconductor unit 300K requires replacement more frequently than the colored photoconductor units 300M, 300Y, 300C due to higher consumption of black toner than colored toner. In other embodiments, all or a subset of colored photoconductor units 300M, 300Y, 300C may be individually removable from imaging basket 400 as desired. FIG. 2 illustrates imaging basket 400 with all four toner cartridges 100, developer units 200 and photoconductor units 300 installed therein. FIG. 3 illustrates imaging basket 400 with developer units 200 and black photoconductor unit 300K removed.

Figure 4:
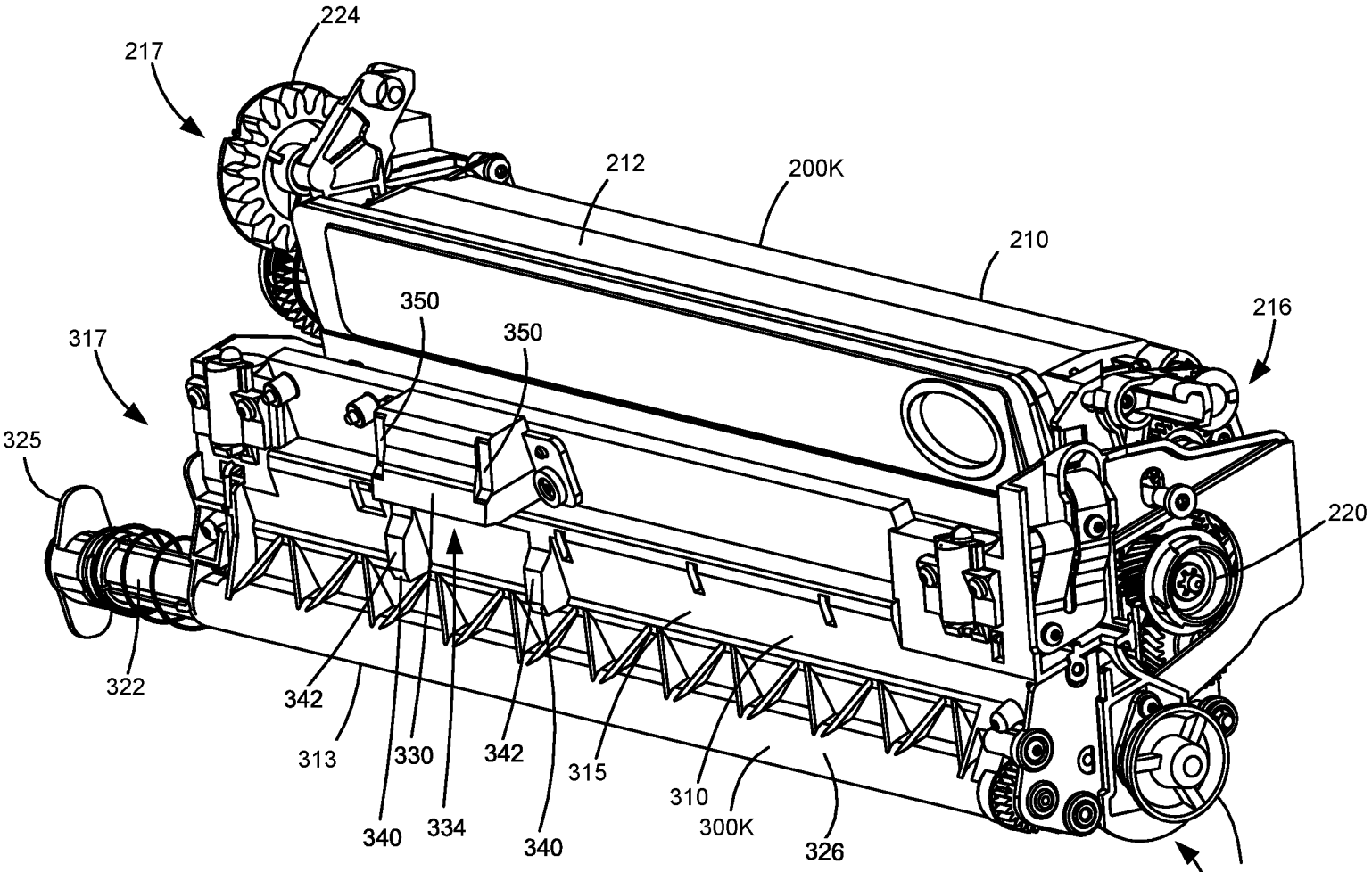
FIG. 4 is a first perspective view of a developer unit and photoconductor unit operably mated together according to one example embodiment.
Figure 5:
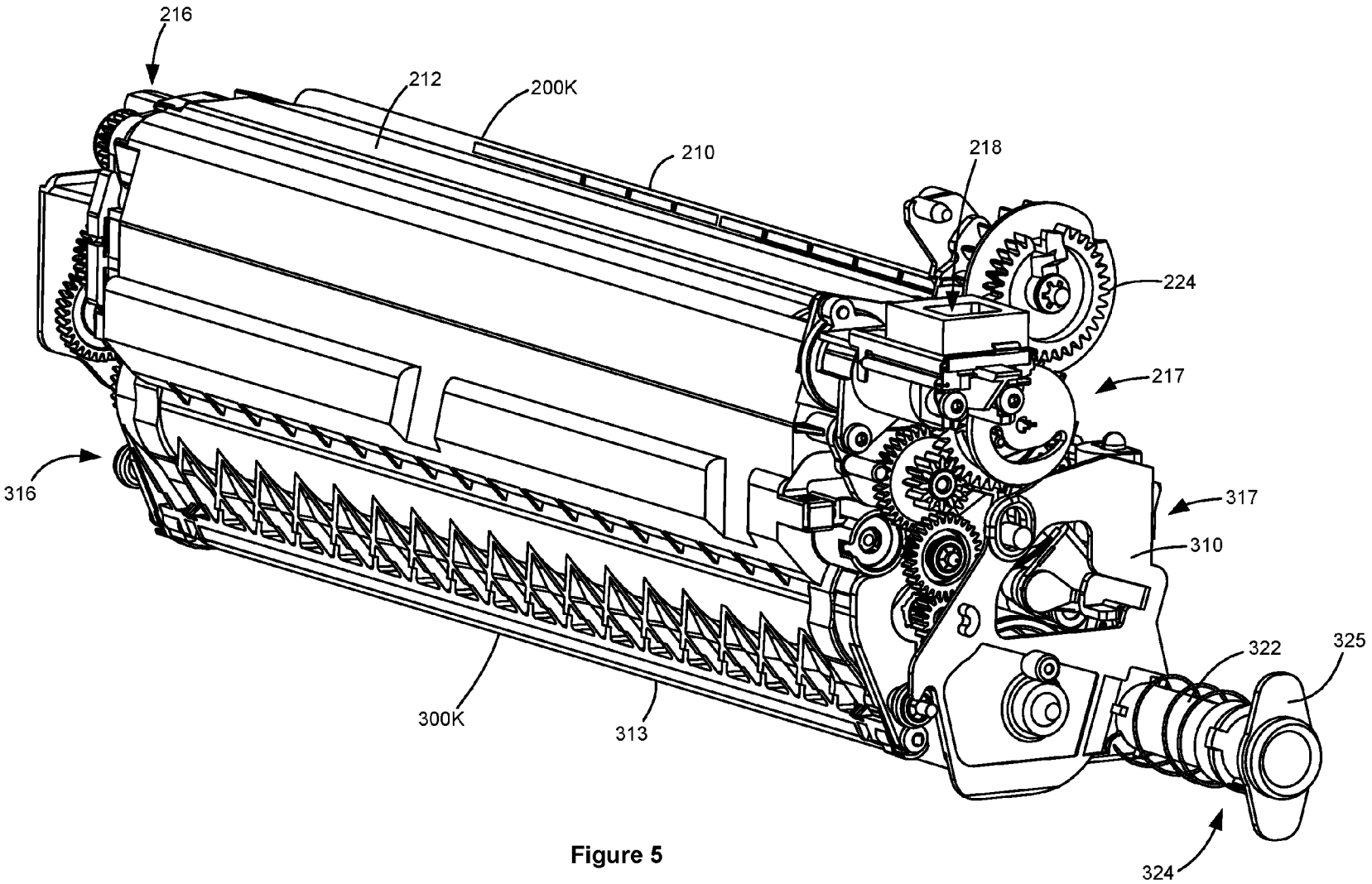
FIG. 5 is a second perspective view of the developer unit and photoconductor unit shown in FIG. 4 operably mated together.
Figure 6:
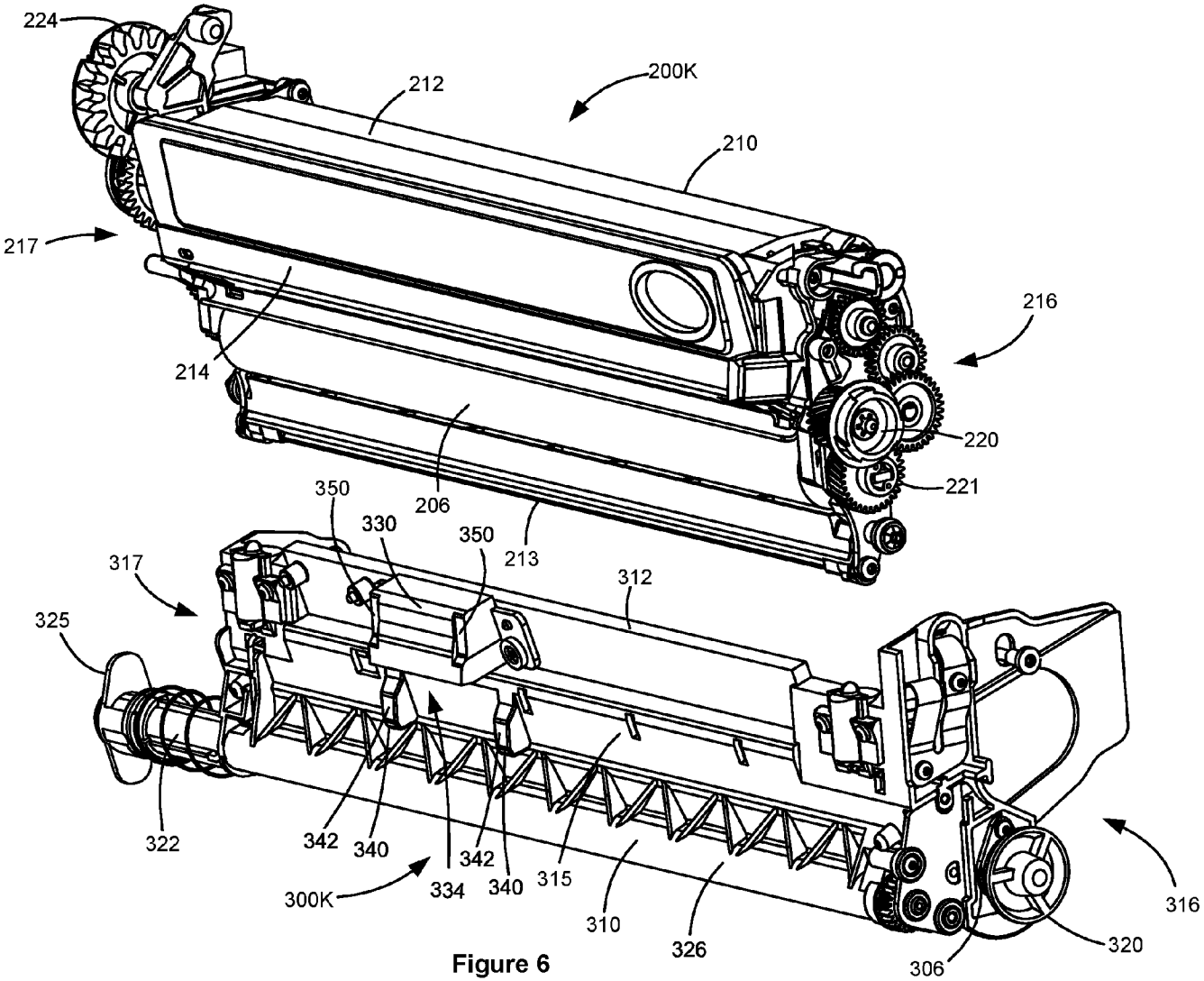
FIG. 6 is a first perspective view of the developer unit and photoconductor unit shown in FIGS. 4 and 5 separated from each other according to one example embodiment.
Figure 7:
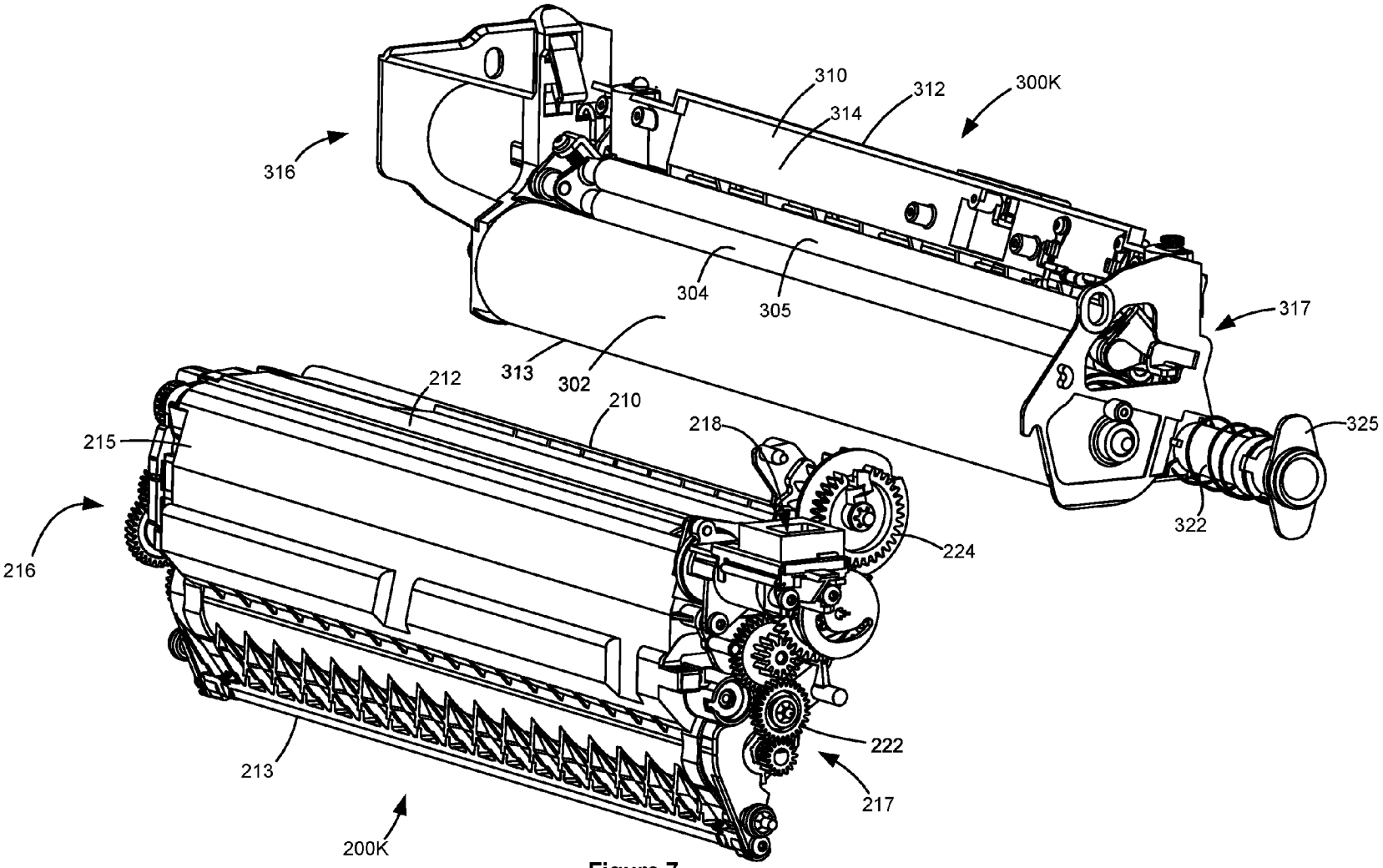
FIG. 7 is a second perspective view of the developer unit and photoconductor unit shown in FIGS. 4-6 separated from each other.

FIGS. 4-7 show removable photoconductor unit 300K and its corresponding developer unit 200K according to one example embodiment. FIGS. 4 and 5 show developer unit 200K operably mated with photoconductor unit 300K. FIGS. 6 and 7 show developer unit 200K separated from photoconductor unit 300K to more clearly illustrate the components of each unit.

Developer unit 200K includes a housing 210 having a top 212, a bottom 213, an inner side 214 that faces photoconductor unit 300K and an outer side 215 that faces away from photoconductor unit 300K. Top 212, bottom 213, inner side 214 and outer side 215 are positioned between a first end 216 and a second end 217 of housing 210. Reservoir 202 is enclosed within housing 210. A toner inlet port 218 is positioned at the top 212 of housing 210 on end 217 for receiving toner from toner cartridge 100 to replenish reservoir 202. Developer roll 206 runs axially from end 216 to end 217 and is exposed on inner side 214. Developer unit 200K includes an input drive coupler 220 exposed on end 216 of housing 210 to mate with and receive rotational motion from a drive system in image forming device 20 when developer unit 200K is installed in image forming device 20. Drive coupler 220 is operatively coupled to developer roll 206 through a drive train 221 on end 216 in order to rotate developer roll 206 when drive coupler 220 rotates. Drive train 221 also transfers rotational motion received by drive coupler 220, via developer roll 206, to toner adder roll 204 and to agitating members positioned within reservoir 202 that aid in moving toner therein. In the example embodiment illustrated, a drive train 222 is operatively connected to drive coupler 220 and positioned on end 217 of housing 210. Drive train 222 includes an output gear 224 positioned to mate with a corresponding input gear on toner cartridge 100 in order to transfer rotational motion to the components of toner cartridge 100.

Photoconductor unit 300K includes a housing 310 having a top 312, a bottom 313, an inner side 314 that faces developer unit 200K and an outer side 315 that faces away from developer unit 200K. Top 312, bottom 313, inner side 314 and outer side 315 are positioned between a first end 316 and a second end 317 of housing 310. PC drum 302 runs axially from end 316 to end 317 and is exposed on inner side 314. PC drum 302 includes an input drive coupler 320 on one axial end of PC drum 302. Drive coupler 320 is exposed on end 316 of housing 310 to mate with and receive rotational motion from a drive system in image forming device 20 when photoconductor unit 300K is installed in image forming device 20 in order to rotate PC drum 302. Charge roll 304 is biased against the outer surface of PC drum 302 and may be driven by friction between the surfaces of charge roll 304 and PC drum 302 or by a gear train connected to drive coupler 320. In the embodiment illustrated, a charge roll cleaner roll 305 is in contact with the outer surface of charge roll 304 and removes toner remnants from the outer surface of charge roll 304. Charge roll cleaner roll 305 may be driven by friction between the surfaces of charge roll cleaner roll 305 and charge roll 304 or by a gear train connected to drive coupler 320.

Photoconductor unit 300K may also include a waste toner path that includes a toner conveying member, such as an auger, therein that moves toner cleaned from PC drum by the cleaner blade/roll to a waste toner compartment in image forming device 20. In the example embodiment illustrated, the waste toner path includes a tube 322 that extends outward in a cantilevered manner from end 317 of housing 310. Tube 322 includes a waste toner outlet port 324 positioned to exit waste toner from the waste toner path into a corresponding waste toner inlet in image forming device 20 when photoconductor unit 300K is installed in image forming device 20. Waste toner outlet port 324 may include a shutter 325 that is movable between a closed position blocking waste toner outlet port 324 to prevent toner from leaking from waste toner outlet port 324 when photoconductor unit 300K is removed from image forming device 20 and an open position unblocking waste toner outlet port 324 to permit toner to pass from the waste toner path in photoconductor unit 300K to the waste toner compartment in image forming device 20 when photoconductor unit 300K is installed in image forming device 20.

In the example embodiment illustrated, developer unit 200K and photoconductor unit 300K are fixed to one another such that developer unit 200K and photoconductor unit 300K are replaceable as a single unit. Developer unit 200K and photoconductor unit 300K may be attached to each other by any suitable method. Further, in other embodiments, developer unit 200K and photoconductor unit 300K are not fixed to each other and are separately replaceable.

With reference to FIGS. 4 and 6, in the embodiment illustrated, housing 310 of photoconductor unit 300K includes an electrical connector 330. In other embodiments, electrical connector 330 is positioned on developer unit 200K. Electrical connector 330 includes processing circuitry for photoconductor unit 300K and/or developer unit 200K and includes one or more electrical contacts 332 (FIGS. 19-21) exposed within a pocket 334 on outer side 315 of housing 310. Pocket 334 faces downward and is open at its bottom end in order to permit a corresponding electrical connector of imaging basket 400 to enter pocket 334 and mate with electrical contacts 332. Housing 310 includes one or more guides 340 on outer side 315 spaced below the entrance to pocket 334. In the example embodiment illustrated, housing 310 includes a pair of guides 340 spaced from each other along the axial dimension of PC drum 302. Guides 340 lead upward toward the entrance to pocket 334 but are spaced in the longitudinal dimension of photoconductor unit 300K wider than the entrance to pocket 334 such that one guide 340 is closer to first end 316 than pocket 334 is to first end 316 and the other guide 340 is closer to second end 317 than pocket 334 is to second end 317. Guides 340 include a tapered or ramped surface 342 that inclines inward toward outer side 315 as it extends upward.

Figure 8:
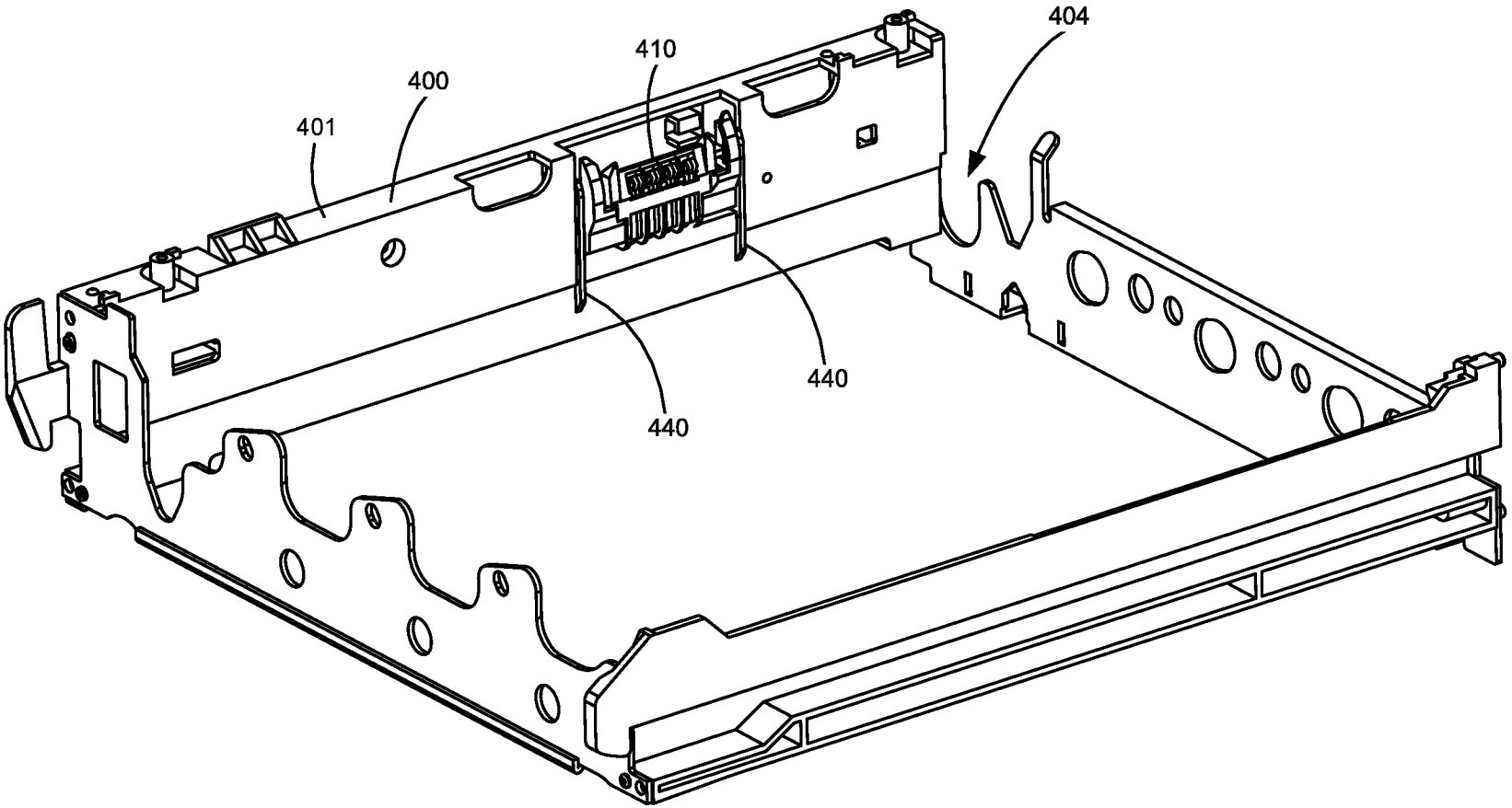
FIG. 8 is a perspective view of an electrical connector positioned on a frame of the imaging basket according to one example embodiment.

FIGS. 8-11 show a corresponding electrical connector 410 that mates with electrical connector 330 when photoconductor unit 300K is installed in imaging basket 400 to facilitate communication between a controller of image forming device 20 and the processing circuitry of electrical connector 330. As shown in FIG. 8, electrical connector 410 is positioned on an inner side of frame 401 of imaging basket 400 adjacent to the positioning slot 404 that holds photoconductor unit 300K and developer unit 200K (see also FIG. 3).

Figure 9:
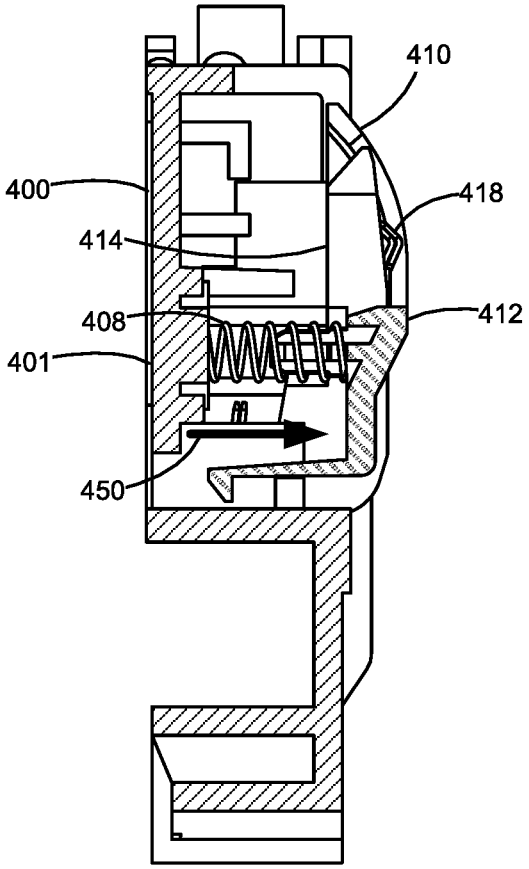
FIG. 9 is a cross-sectional end view of the electrical connector of the imaging basket according to one example embodiment.

Electrical connector 410 is movable toward and away from positioning slot 404, transverse to the rotational axis of PC drum 302. As shown in FIG. 9, electrical connector 410 is biased by one or more biasing members, e.g., one or more compression springs 408, away from frame 401 and toward positioning slot 404 (in the direction indicated by arrow 450 in FIG. 9).

Figure 10:
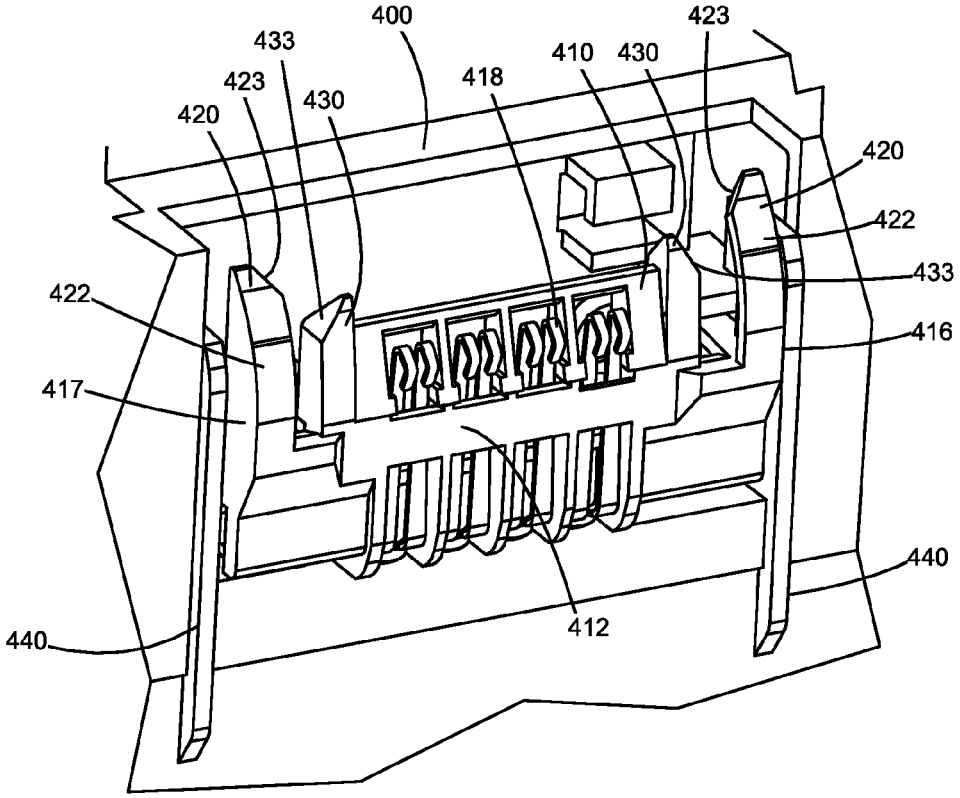
FIG. 10 is a front perspective view of the electrical connector of the imaging basket according to one example embodiment.
Figure 11:
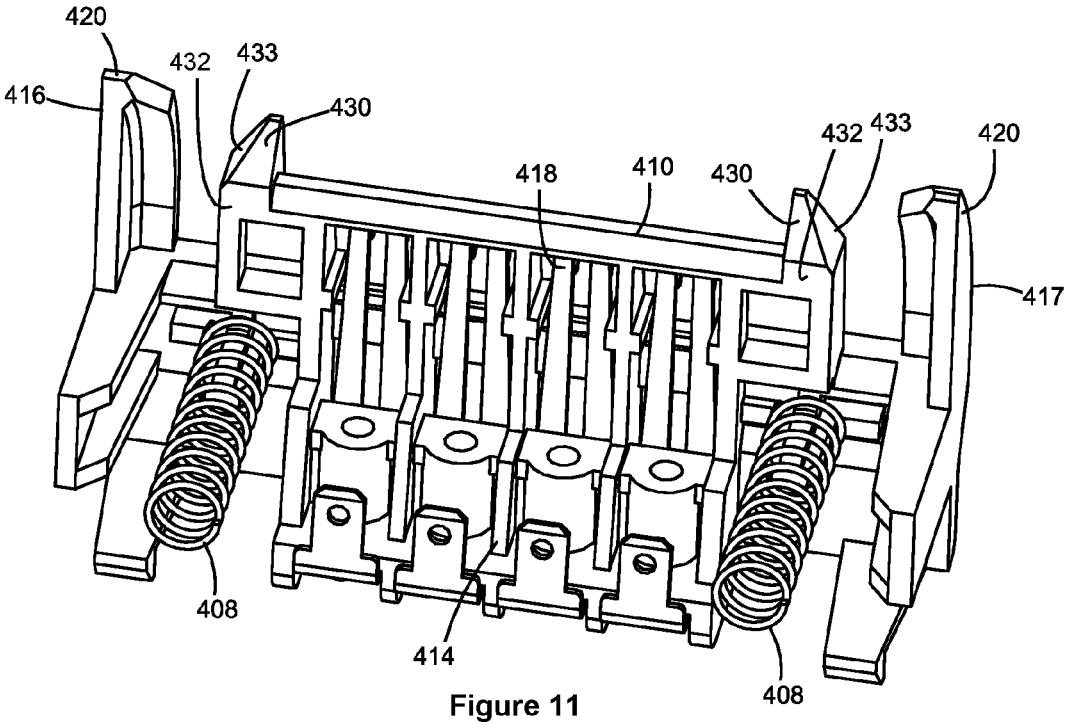
FIG. 11 is a rear perspective view of the electrical connector of the imaging basket according to one example embodiment.

FIGS. 10 and 11 show a front side 412 and a rear side 414 of electrical connector 410, respectively, in greater detail. Front side 412 faces into positioning slot 404 and rear side 414 is positioned opposite front side 412. Electrical connector 410 also includes a first end 416 and a second end 417. One or more electrical contacts 418 are positioned on front side 412 of electrical connector 410. Contacts 418 mate with corresponding electrical contacts 332 of electrical connector 330 when photoconductor unit 300K is installed in imaging basket 400. Contacts 418 are in communication with a controller of image forming device 20 permitting communication between the controller of image forming device 20 and the processing circuitry of electrical connector 330. Electrical connector 410 includes a first pair of guides 420 positioned at the ends 416, 417 of electrical connector 410 and a second pair of guides 430 spaced inward toward each other from guides 420 but positioned on opposite ends of electrical contacts 418.

As shown in FIG. 10, the top portions of front surfaces 422 of guides 420 taper rearward (in a direction opposite the bias on electrical connector 410) away from positioning slot 404 as they extend upward and the bottom portions of front surfaces 422 of guides 420 taper rearward as they extend downward. Inner surfaces 423 of guides 420 at the tops of guides 420 may taper inward toward each other as they extend downward. As shown in FIG. 11, the top portions of rear surfaces 432 of guides 430 taper forward (in the direction of bias on electrical connector 410) toward positioning slot 404 as they extend upward. Outer surfaces 433 of guides 430 at the tops of guides 430 may taper outward away from each other as they extend downward.

In the example embodiment illustrated, imaging basket 400 also includes a pair of vertical positioning guides or ribs 440 that protrude forward from frame 401 toward positioning slot 404. Ribs 440 are positioned just past the ends 416, 417 of electrical connector 410. Ribs 440 extend downward below electrical connector 410.

Figure 12:
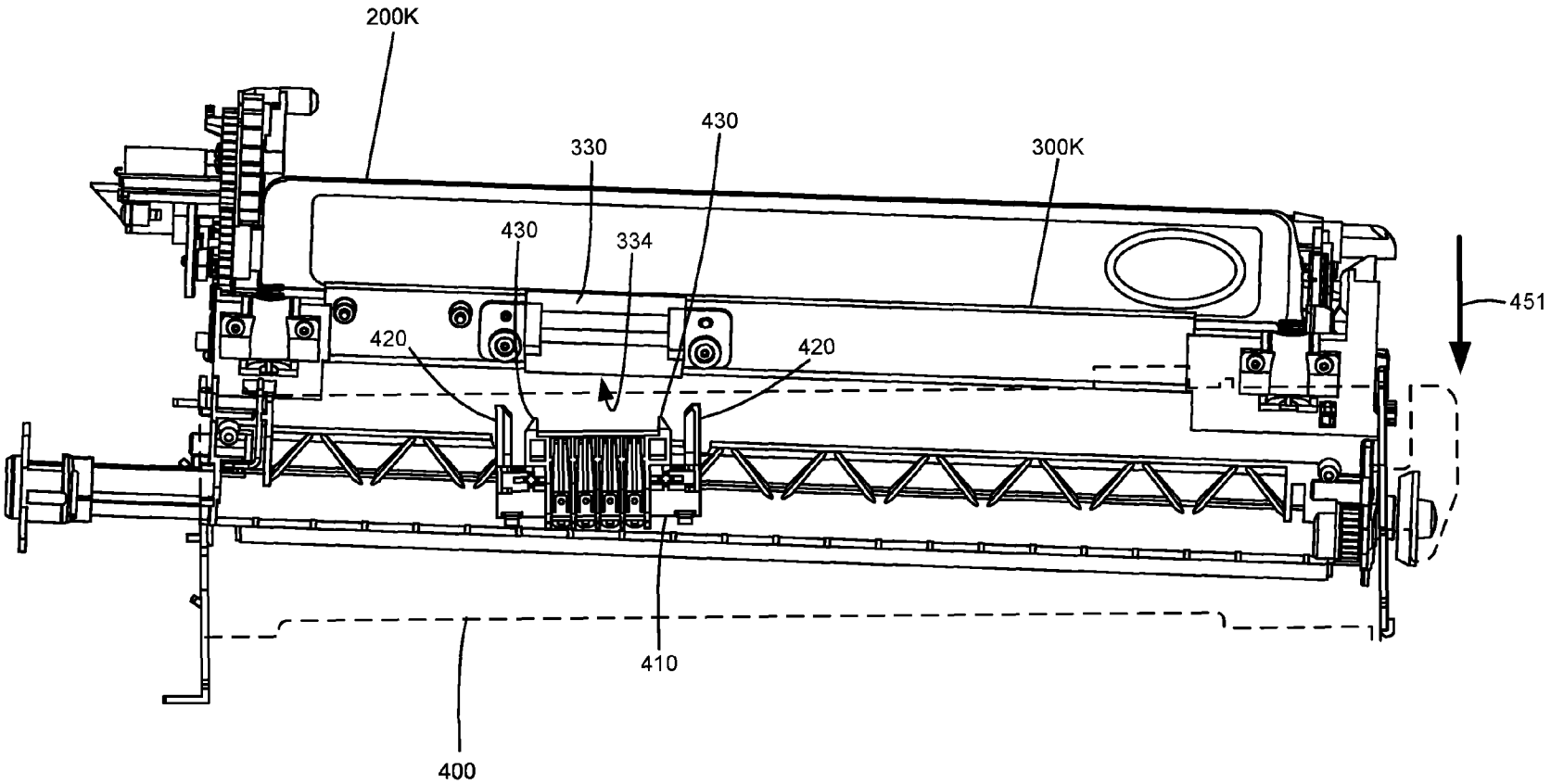
FIG. 12 is a side elevation view showing the electrical connector of the imaging basket aligned with an electrical connector of the photoconductor unit as the photoconductor unit is being installed in the imaging basket according to one example embodiment.

FIG. 12 shows electrical connector 410 aligned with electrical connector 330 as photoconductor unit 300K is being installed in imaging basket 400 (which is outlined in dashed lines in FIG. 12 for clarity) but before photoconductor unit 300K reaches its final position in imaging basket 400. As photoconductor unit 300K is lowered into positioning slot 404 as indicated by the arrow 451 in FIG. 12, guides 430 of electrical connector 410 and electrical contacts 418 enter pocket 334 where electrical contacts 418 mate with electrical contacts 332 while guides 420 pass along the ends of electrical connector 330 outside of pocket 334.

Figure 13:
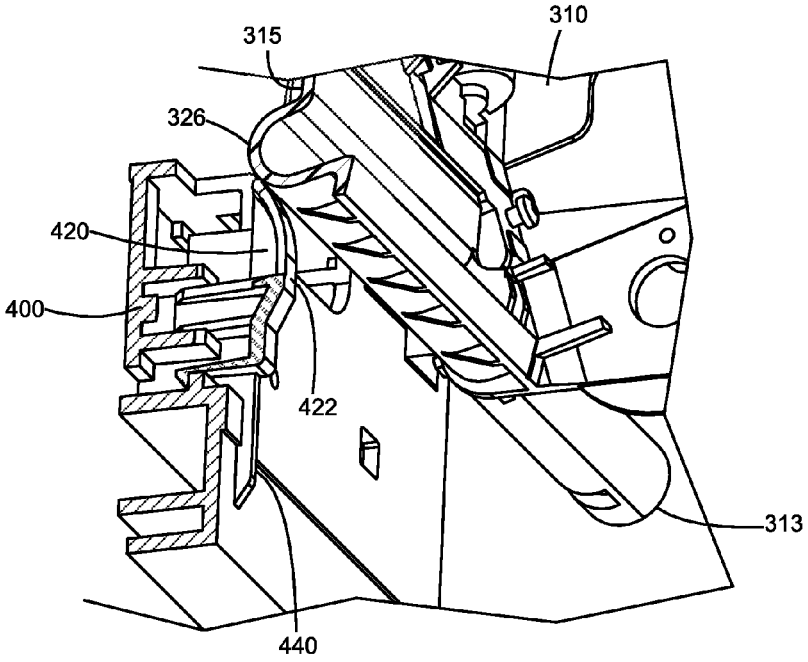
FIGS. 13 and 14 are a cross-sectional perspective view and a cross-sectional end view, respectively, of the photoconductor unit as the photoconductor unit is lowered into the imaging basket with a portion of the photoconductor unit contacting a guide of the electrical connector of the imaging basket according to one example embodiment.
Figure 14:
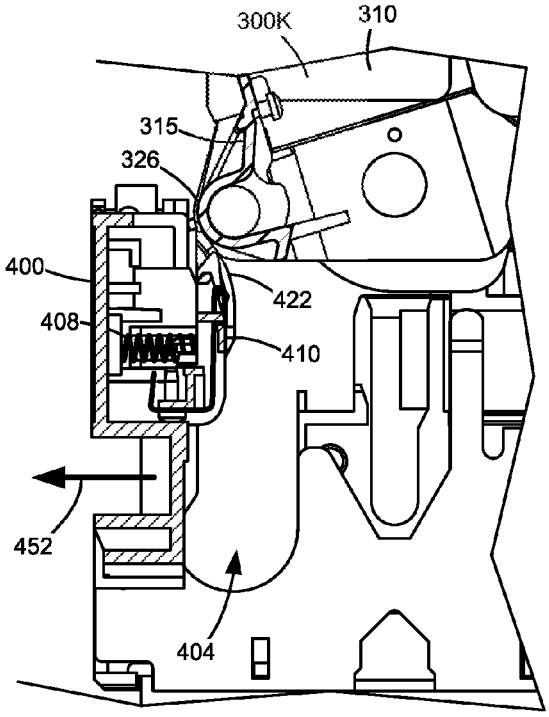

FIGS. 13-22 illustrate the mating of electrical connector 330 with electrical connector 410 in greater detail according to one example embodiment. FIGS. 13 and 14 show photoconductor unit 300K as it is first lowered into positioning slot 404 of imaging basket 400. As photoconductor unit 300K lowers into positioning slot 404 and bottom 313 of housing 310 reaches electrical connector 410, a portion 326 of housing 310 that protrudes from outer side 315 of housing 310 and that forms an auger channel, which feeds toner to tube 322 and waste toner outlet port 324, contacts front surfaces 422 of guides 420. As photoconductor unit 300K continues to lower into positioning slot 404, the force from the protruding auger channel portion 326 of housing 310 on the front surfaces 422 of guides 420 overcomes the bias on electrical connector 410 and pushes electrical connector 410 rearward (in the direction indicated by arrow 452 in FIG. 14), away from photoconductor unit 300K, opposite the direction of bias on electrical connector 410 due to the taper of front surfaces 422 of guides 420.

Figure 15:
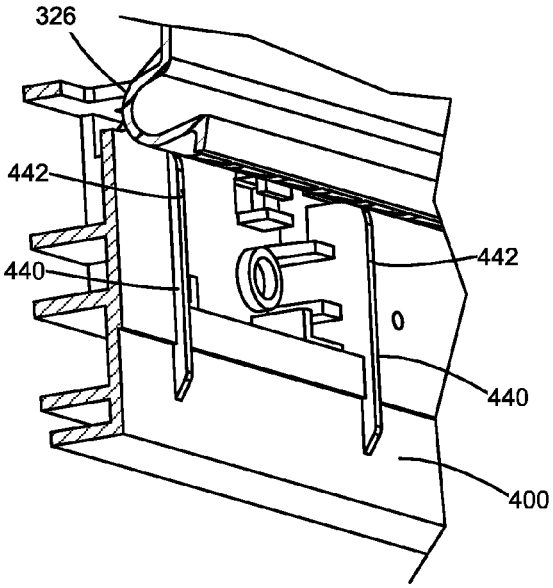
FIGS. 15 and 16 are a cross-sectional perspective view and a cross-sectional end view, respectively, of the photoconductor unit as the photoconductor unit is lowered further into the imaging basket with a portion of the photoconductor unit pushing the electrical connector of the imaging basket away from the photoconductor unit according to one example embodiment.
Figure 16:
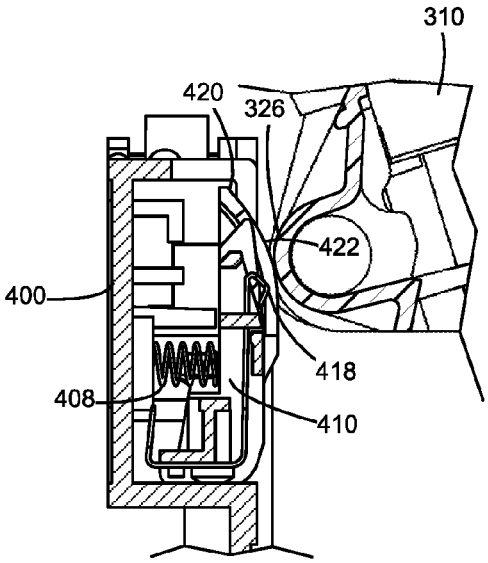
Figure 17:
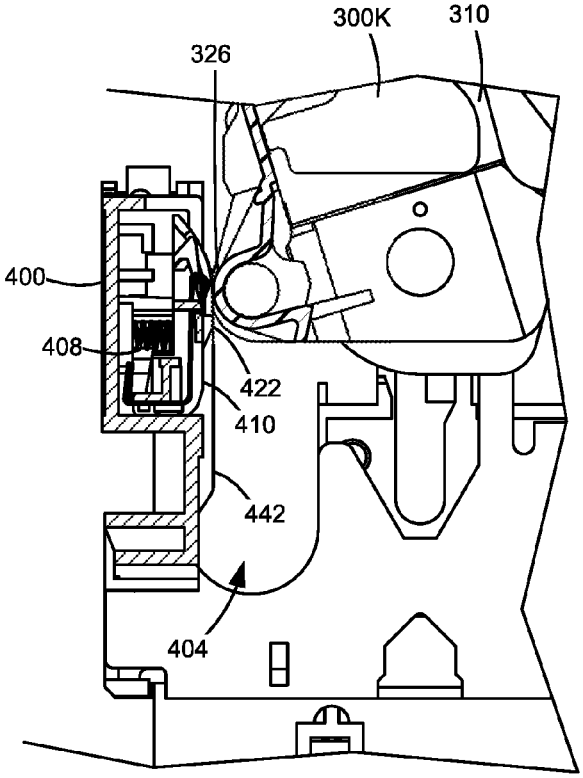
FIG. 17 is a cross-sectional end view of the photoconductor unit as the photoconductor unit is lowered further into the imaging basket with a portion of the photoconductor unit in contact with positioning ribs on the imaging basket according to one example embodiment.

With reference to FIGS. 15-17, as photoconductor unit 300K continues to lower into positioning slot 404, the protruding auger channel portion 326 of housing 310 pushes electrical connector 410 rearward until the portions of front surfaces 422 of guides 420 contacting the protruding auger channel portion 326 of housing 310 are in line with vertical positioning ribs 440 clearing electrical connector 410 from the downward insertion path of photoconductor unit 300K. As shown in FIG. 16, electrical contacts 418 of electrical connector 410 are spaced below and/or rearward from front surfaces 422 of guides 420 so that housing 310 does not make contact with electrical contacts 418 as housing 310 moves past electrical connector 410 in order to protect electrical contacts 418 from damage. As photoconductor unit 300K continues to advance downward, the protruding auger channel portion 326 of housing 310 remains in contact with front surfaces 442 of vertical positioning ribs 440, which aid in guiding the continued insertion of photoconductor unit 300K as shown in FIG. 17.

Figure 18:
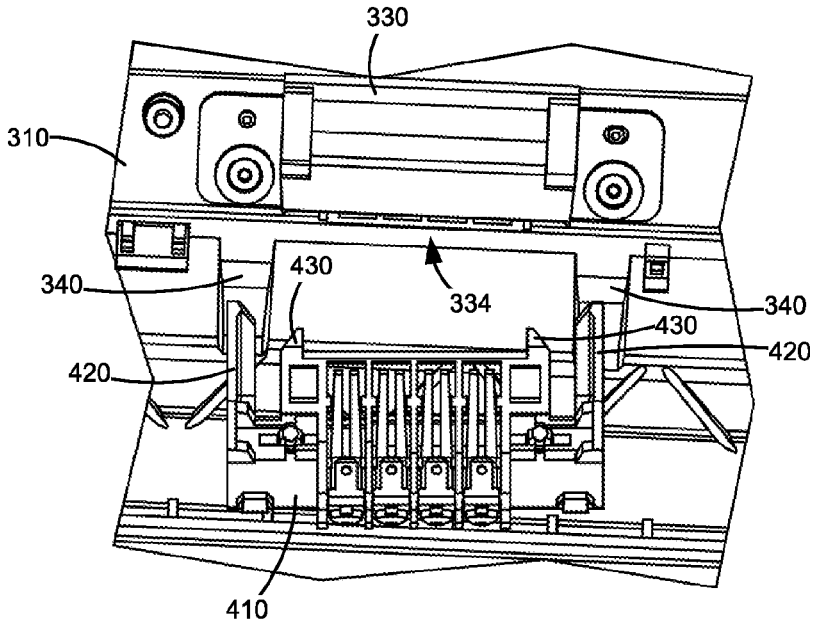
FIG. 18 is a side elevation view showing the electrical connector of the imaging basket approaching the electrical connector of the photoconductor unit as the photoconductor unit is lowered further into the imaging basket according to one example embodiment.
Figure 19:
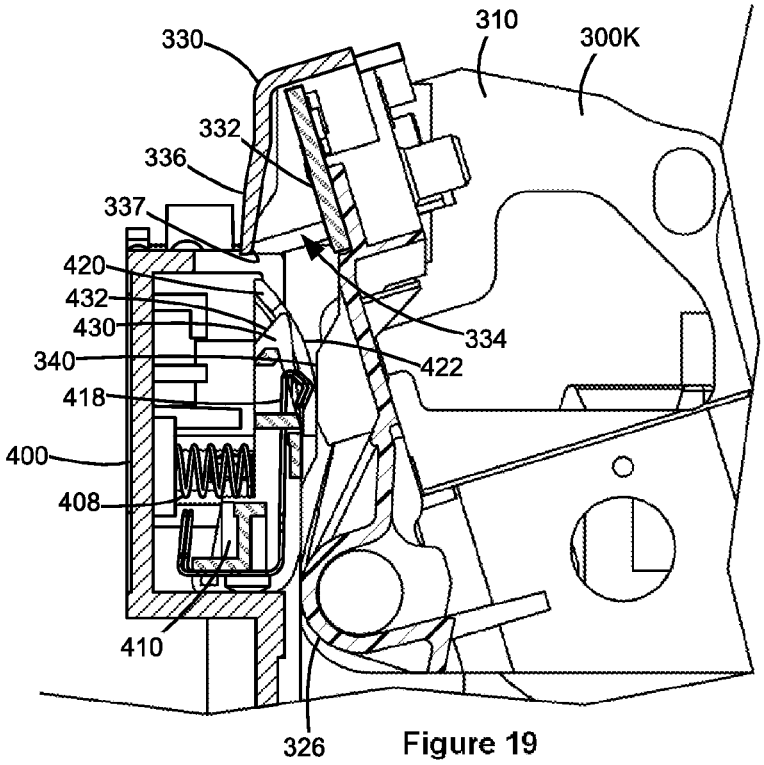
FIG. 19 is a cross-sectional end view of the photoconductor unit as the photoconductor unit is lowered further into the imaging basket with the electrical connector of the imaging basket approaching the electrical connector of the photoconductor unit according to one example embodiment.

With reference to FIGS. 18 and 19, as photoconductor unit 300K continues to lower into positioning slot 404, the protruding auger channel portion 326 of housing 310 passes below electrical connector 410 causing electrical connector 410 to move forward toward housing 310 as a result of the bias on electrical connector 410 until front surfaces 422 of guides 420 begin to contact guides 340 that are positioned below electrical connector 330 and above the protruding auger channel portion 326 of housing 310. The engagement between guides 340 and guides 420 aligns electrical connector 410 along the direction of bias on electrical connector 410 with pocket 334 and ensures that electrical contacts 418 remain spaced from housing 310 to avoid damaging electrical contacts 418. As shown in FIG. 19, an inner surface 336 of pocket 334 that is spaced away from outer side 315 of housing 310 may include a tapered lead-in 337 to help funnel electrical connector 410 into pocket 334. The taper of the top portions of rear surfaces 432 of guides 430 also aid in funneling electrical connector 410 into pocket 334.

Figure 20:
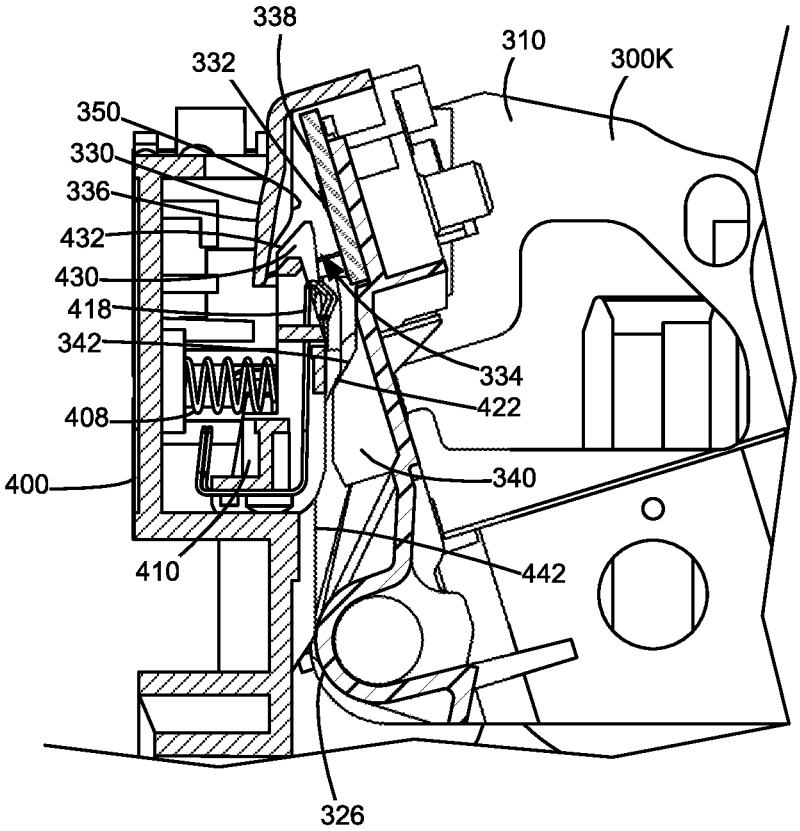
FIG. 20 is a cross-sectional end view of the photoconductor unit as the photoconductor unit is lowered further into the imaging basket with the electrical connector of the imaging basket entering a pocket of the electrical connector of the photoconductor unit according to one example embodiment.

FIG. 20 shows photoconductor unit 300K advanced further into positioning slot 404 with the top portions of guides 430 entering pocket 334 and the top portions of guides 420 passing along the ends of pocket 334, outside of pocket 334. The taper of inner surfaces 423 of guides 420 and outer surfaces 433 of guides 430 aids in funneling electrical connector 410 into pocket 334. The incline of ramped surface 342 of guides 340 and the corresponding taper of the bottom portions of front surfaces 422 of guides 420 causes electrical connector 410 to gradually move toward the electrical contacts 332 of electrical connector 330, which are positioned on an inner surface 338 of pocket 334 that is positioned against outer side 315 of housing 310, as photoconductor unit 300K advances downward. In the embodiment illustrated, one or more guides 350 are positioned on inner surface 336 of pocket 334, on the opposite side of pocket 334 relative to electrical contact(s) 332. Guide(s) 350 taper inward toward outer side 315 of housing 310 as they extend upward. In one embodiment, a pair of guides 350 are positioned on inner surface 336 of pocket 334 (in the positions indicated in FIGS. 4 and 6) and are aligned in the longitudinal dimension of housing 310 with guides 430 allowing guides 350 to contact rear surfaces 432 of guides 430 when electrical connector 410 enters pocket 334 in order to further guide electrical contacts 418 toward electrical contacts 332.

Figure 21:
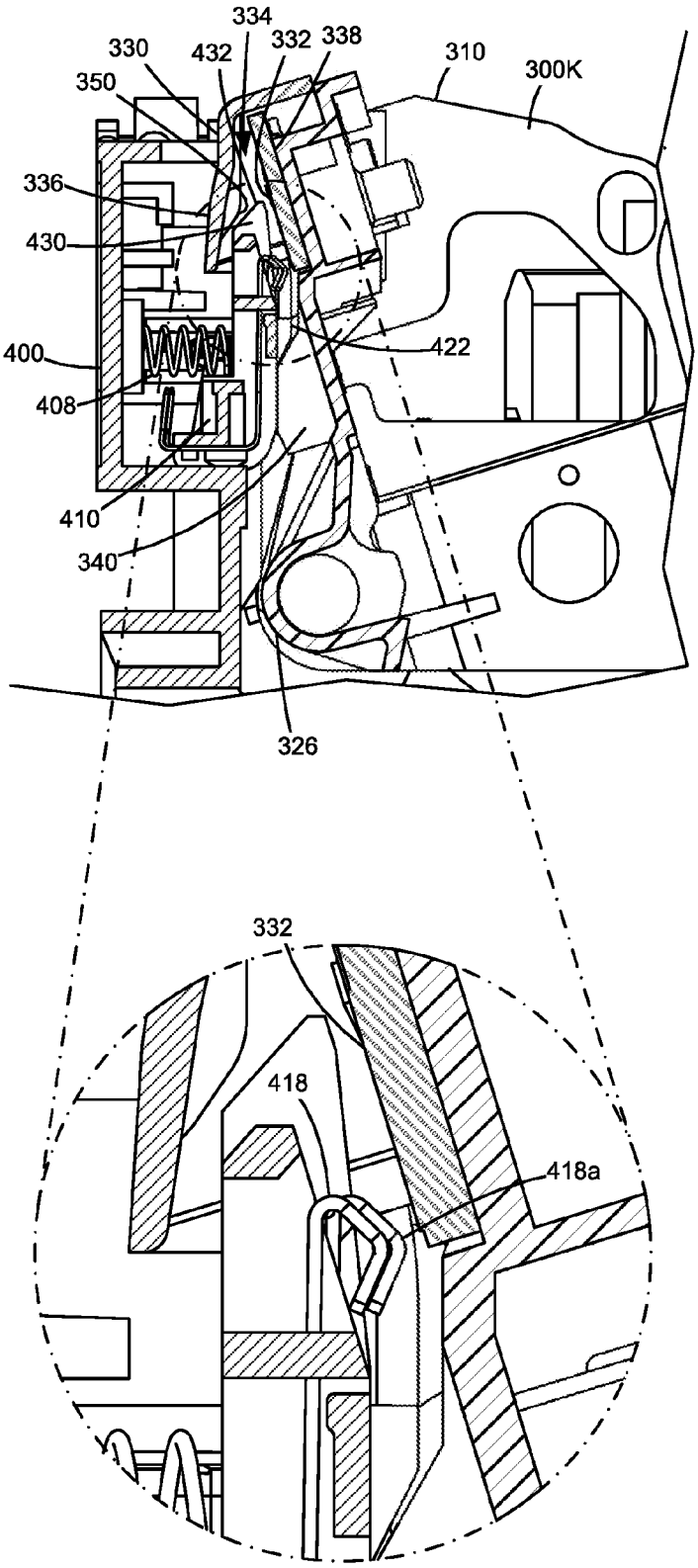
FIG. 21 is a cross-sectional end view of the photoconductor unit as the photoconductor unit is lowered further into the imaging basket with the electrical connector of the imaging basket advancing further into the pocket of the electrical connector of the photoconductor unit according to one example embodiment.

FIG. 21 shows photoconductor unit 300K advanced further into positioning slot 404 with electrical connector 410 positioned further upward in pocket 334 and electrical contacts 418 positioned further forward toward electrical contacts 332 as a result of the movement of guides 420 against guides 340. As shown in FIG. 21, in one embodiment, a ground contact 418*a* of electrical contacts 418 extends further forward than the other electrical contacts 418, which may provide power, data and clock lines, respectively, in order to ensure that ground contact 418*a* makes contact with its corresponding electrical contact 332 first during insertion of photoconductor unit 300K into imaging basket 400 and breaks from its corresponding electrical contact 332 last during removal of photoconductor unit 300K from imaging basket 400.

Figure 22:
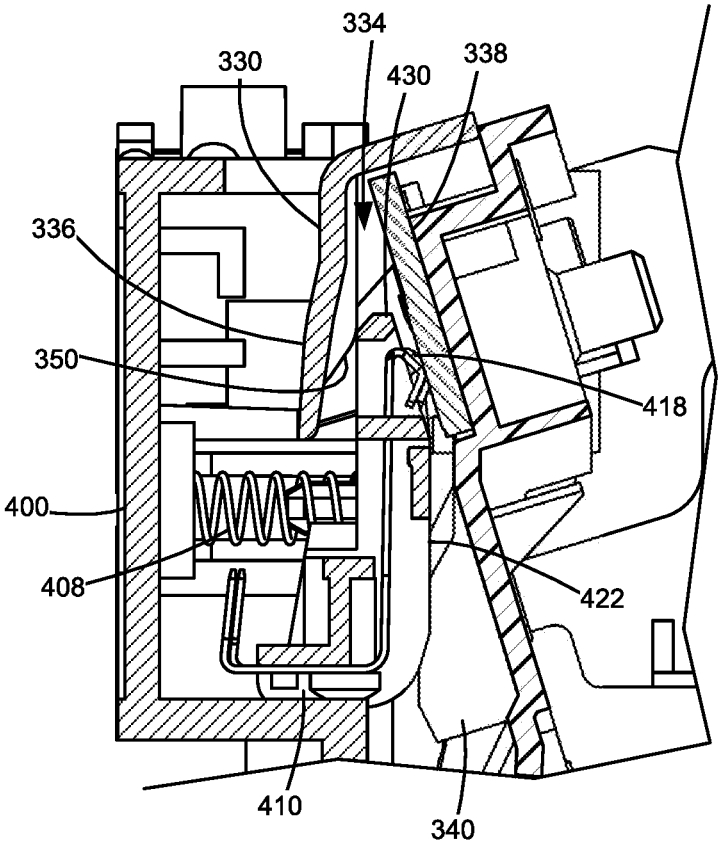
FIG. 22 is a cross-sectional end view of the photoconductor unit fully installed in the imaging basket with the electrical connector of the imaging basket mated with the electrical connector of the photoconductor unit according to one example embodiment.

FIG. 22 shows photoconductor unit 300K fully installed in imaging basket 400 with electrical connector 330 fully mated with electrical connector 410. When electrical connector 330 and electrical connector 410 are fully mated, guides 340 serve as a stop for electrical connector 410 against the bias on electrical connector 410 and guides 350 inside of pocket 334 serve as a stop for electrical connector 410 against the force on electrical contacts 418 from electrical contacts 332 in embodiments where electrical contacts 418 include resiliently deflectable metal tongs that are deflected rearward by electrical contacts 332. The engagement between guides 340 and 350 and electrical connector 410 stabilizes electrical connector 410 within pocket 334.

This sequence is reversed when photoconductor unit 300K is removed from imaging basket 400. As photoconductor unit 300K moves upward, the incline of guides 340 and the corresponding taper of the bottoms of front surfaces 422 of guides 420 force electrical connector 410 rearward against the bias on electrical connector 410 so that electrical contacts 418 do not drag or scrape along housing 310. The protruding auger channel portion 326 of housing 310 contacts guides 420 as photoconductor unit 300K is removed further from imaging basket 400 causing electrical connector 410 to move further rearward clear of the removal path of the protruding auger channel portion 326 of housing 310. As the protruding auger channel portion 326 of housing 310 passes, the bias on electrical connector 410 causes electrical connector 410 to return forward, toward positioning slot 404.

As desired, photoconductor units 300M, 300Y, 300C may be removable from imaging basket 400 and may have the same construction as photoconductor unit 300K, each including a respective electrical connector 330 that mates with a corresponding electrical connector 410 in imaging basket 400. Similarly, developer units 200M, 200Y, 200C may have the same construction as developer unit 200K and may be fixed to or replaceable separate from their corresponding photoconductor units 300M, 300Y, 300C. Further, in another embodiment, imaging stations 50 do not include toner cartridges 100 and, instead, developer units 200K, 200M, 200Y, 200C include in their respective reservoirs 202 the main toner supply of each toner color.

While the example embodiment illustrated includes electrical connector 330 on photoconductor unit 300K, it will be appreciated that an electrical connector having the features of electrical connector 330 could be included on one or more of developer units 200 or toner cartridges 100. Further, some or all of the features of electrical connector 330 could be shifted to electrical connector 410 or vice versa. For example, electrical connector 330 could be movable and include features such as those shown on electrical connector 410 and electrical connector 410 could be fixed and include features such as those shown on electrical connector 330. Further, although the example embodiment illustrated includes a downward insertion and upward removal of photoconductor unit 300K, various other insertion and removal paths may be used as desired, e.g., a forward, rearward or sideways insertion or a rotating insertion, with the orientations of electrical connectors 330 and 410 modified to reflect the modified insertion and removal directions.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure. Relatively apparent modifications include combining one or more features of various embodiments with features of other embodiments.

The invention claimed is:

1. A replaceable unit for an electrophotographic image forming device, comprising:

a housing having a top, a bottom, a first side and a second side formed between a first end and a second end of the housing;

a pocket formed on the first side of the housing, a bottom end of the pocket is open for receiving an electrical connector during insertion of the replaceable unit along a downward insertion direction into the image forming device;

an electrical contact positioned within the pocket, the electrical contact is electrically connected to processing circuitry mounted on the housing;

an outer guide positioned on the first side of the housing, the outer guide is positioned ahead of the pocket along the downward insertion direction, at least a portion of the outer guide inclines inward toward the first side of the housing as the outer guide extends upward; and an inner guide positioned within the pocket on a first inner surface of the pocket, the first inner surface of the pocket faces inward toward the first side of the housing, at least a portion of the inner guide inclines inward toward the first side of the housing as the inner guide extends upward.

2. The replaceable unit of claim 1, wherein the outer guide includes a pair of outer guides positioned on the first side of the housing, the outer guides are positioned ahead of the pocket along the downward insertion direction, the outer guides are spaced from each other along a dimension from the first end of the housing to the second end of the housing, at least a portion of each of the outer guides inclines inward toward the first side of the housing as said outer guide extends upward.

3. The replaceable unit of claim 2, wherein one of the pair of outer guides is positioned closer to the first end of the housing than the pocket is to the first end of the housing and the other of the pair of outer guides is positioned closer to the second end of the housing than the pocket is to the second end of the housing.

4. The replaceable unit of claim 1, wherein the electrical contact is positioned within the pocket on a second inner surface of the pocket that is positioned against the first side of the housing, the first inner surface of the pocket is spaced opposite the second inner surface of the pocket.

5. The replaceable unit of claim 1, wherein the inner guide includes a pair of inner guides positioned within the pocket on the first inner surface of the pocket, the inner guides are spaced from each other along a dimension from the first end of the housing to the second end of the housing, at least a portion of each of the pair of inner guides inclines inward toward the first side of the housing as said inner guide extends upward.

6. A replaceable unit for an electrophotographic image forming device, comprising:

a housing having a top, a bottom, a first side and a second side formed between a first end and a second end of the housing;

a photoconductive drum mounted on the housing having a rotational axis that runs from the first end to the second end;

a downward facing pocket formed on the first side of the housing, a bottom end of the pocket is open for receiving an electrical connector when the replaceable unit is installed in the image forming device;

an electrical contact positioned within the pocket on a first inner surface of the pocket that is positioned against the first side of the housing, the electrical contact is electrically connected to processing circuitry mounted on the housing;

a pair of outer guides positioned on the first side of the housing, the outer guides are spaced below the bottom end of the pocket and are spaced from each other along an axial dimension of the photoconductive drum, at least a portion of each of the outer guides inclines inward toward the first side of the housing as said outer guide extends upward; and an inner guide positioned within the pocket on a second inner surface of the pocket, the second inner surface of the pocket faces inward toward the first side of the housing and is spaced opposite the first inner surface of the pocket, at least a portion of the inner guide inclines inward toward the first side of the housing as the inner guide extends upward.

7. The replaceable unit of claim 6, wherein one of the pair of outer guides is positioned closer to the first end of the housing than the pocket is to the first end of the housing and the other of the pair of outer guides is positioned closer to the second end of the housing than the pocket is to the second end of the housing.

8. The replaceable unit of claim 6, wherein the inner guide includes a pair of inner guides positioned within the pocket on the second inner surface of the pocket, the inner guides are spaced from each other along the axial dimension of the photoconductive drum, at least a portion of each of the pair of inner guides inclines inward toward the first side of the housing as said inner guide extends upward.

9. The replaceable unit of claim 6, further comprising a protruding portion of the housing that protrudes from the first side of the housing below the outer guides, the protruding portion of the housing houses a channel for moving toner cleaned from an outer surface of the photoconductive drum.

10. A replaceable unit for an electrophotographic image forming device, comprising:

a housing having a top, a bottom, a first side and a second side formed between a first end and a second end of the housing;

a photoconductive drum mounted on the housing having a rotational axis that runs from the first end to the second end;

a downward facing pocket formed on the first side of the housing, a bottom end of the pocket is open for receiving an electrical connector when the replaceable unit is installed in the image forming device;

an electrical contact positioned within the pocket, the electrical contact is electrically connected to processing circuitry mounted on the housing;

an outer guide positioned on the first side of the housing, the outer guide is spaced below the bottom end of the pocket, at least a portion of the outer guide inclines inward toward the first side of the housing as the outer guide extends upward; and a protruding portion of the housing that protrudes from the first side of the housing below the outer guide, the protruding portion of the housing houses a channel for moving toner cleaned from an outer surface of the photoconductive drum.

11. The replaceable unit of claim 10, wherein the outer guide includes a pair of outer guides positioned on the first side of the housing, the outer guides are spaced below the bottom end of the pocket and are spaced from each other along an axial dimension of the photoconductive drum, at least a portion of each of the outer guides inclines inward toward the first side of the housing as said outer guide extends upward.

12. The replaceable unit of claim 11, wherein one of the pair of outer guides is positioned closer to the first end of the housing than the pocket is to the first end of the housing and the other of the pair of outer guides is positioned closer to the second end of the housing than the pocket is to the second end of the housing.

13. The replaceable unit of claim 10, wherein the electrical contact is positioned within the pocket on an inner surface of the pocket that is positioned against the first side of the housing.

14. The replaceable unit of claim 10, further comprising an inner guide positioned within the pocket on an inner surface of the pocket, the inner surface of the pocket faces inward toward the first side of the housing, at least a portion of the inner guide inclines inward toward the first side of the housing as the inner guide extends upward.

15. The replaceable unit of claim 14, wherein the inner guide includes a pair of inner guides positioned within the pocket on the inner surface of the pocket, the inner guides are spaced from each other along an axial dimension of the photoconductive drum, at least a portion of each of the pair of inner guides inclines inward toward the first side of the housing as said inner guide extends upward.

* * * * *